US010058970B2

(12) United States Patent
Gagliardi et al.

(10) Patent No.: US 10,058,970 B2
(45) Date of Patent: Aug. 28, 2018

(54) INTERRUPTED STRUCTURED ABRASIVE ARTICLE AND METHODS OF POLISHING A WORKPIECE

(71) Applicant: 3M INNOVATIVE PROPERTIES COMPANY, St. Paul, MN (US)

(72) Inventors: John J. Gagliardi, Hudson, WI (US); Vincent D. Romero, Woodbury, MN (US); Eric C. Coad, Woodbury, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 10 days.

(21) Appl. No.: 15/308,198

(22) PCT Filed: Apr. 22, 2015

(86) PCT No.: PCT/US2015/027105

§ 371 (c)(1),
(2) Date: Nov. 1, 2016

(87) PCT Pub. No.: WO2015/167899

PCT Pub. Date: Nov. 5, 2015

(65) Prior Publication Data

US 2017/0057043 A1 Mar. 2, 2017

Related U.S. Application Data

(60) Provisional application No. 61/987,728, filed on May 2, 2014.

(51) Int. Cl.
*B24B 7/22* (2006.01)
*B24B 37/26* (2012.01)
(Continued)

(52) U.S. Cl.
CPC ..... *B24B 7/228* (2013.01); *B24B 37/22* (2013.01); *B24B 37/245* (2013.01); *B24B 37/26* (2013.01); *B24D 11/00* (2013.01)

(58) Field of Classification Search
CPC ..... B24B 7/22; B24B 7/228; B24B 37/22; B24B 37/24; B24B 37/26; B24B 37/225
(Continued)

(56) References Cited

U.S. PATENT DOCUMENTS 4,311,489 A 1/1982 Kressner
4,652,274 A 3/1987 Boettcher
(Continued)

FOREIGN PATENT DOCUMENTS

WO WO 2007-121052 10/2007
WO WO 2008/109211 9/2008
(Continued)

OTHER PUBLICATIONS

Electronic Lapping with Trizact Diamond Tile Faster Cut rates—with less subsurface damage—boost productivity, 2003, 2 pages.
(Continued)

*Primary Examiner* — Robert Rose
(74) *Attorney, Agent, or Firm* — Adam Bramwell

(57) ABSTRACT

Interrupted structured abrasive articles comprise an abrasive layer comprising shaped abrasive composites that extend outwardly from a first major surface of a backing to which they are secured. The abrasive layer defines at least one open region that is free of the shaped abrasive composites and may extend partially or completely through the backing. In some embodiments, each of the open regions comprises a circular area of at least 1.5 square centimeters, and when combined the open regions have total area that is at least 10
(Continued)

percent of the area of the first major surface of the backing. Interrupted abrasive articles are useful in single-sided polishing processes.

16 Claims, 6 Drawing Sheets

(51) Int. Cl.
*B24B 37/22* (2012.01)
*B24B 37/24* (2012.01)
*B24D 11/00* (2006.01)

(58) Field of Classification Search
USPC ..... 451/28, 526, 527, 533, 534, 530, 539; 51/297, 298
See application file for complete search history.

(56) References Cited

U.S. PATENT DOCUMENTS 4,652,275 A 3/1987 Bloecher
4,751,138 A 6/1988 Tumey
4,773,920 A 9/1988 Chasman
4,799,939 A 1/1989 Bloecher
4,903,440 A 2/1990 Larson
5,014,468 A * 5/1991 Ravipati ..... B24D 3/28 51/293
5,152,917 A 10/1992 Pieper
5,236,472 A 8/1993 Kirk
5,256,170 A 10/1993 Harmer
5,435,816 A 7/1995 Spurgeon
5,454,844 A 10/1995 Hibbard
5,549,962 A 8/1996 Holmes
5,580,647 A 12/1996 Larson
5,672,097 A 9/1997 Hoopman
5,681,217 A 10/1997 Hoopman
5,692,950 A 12/1997 Rutherford
5,851,247 A 12/1998 Stoetzel
5,958,794 A 9/1999 Bruxvoort
5,975,988 A 11/1999 Christianson
6,139,594 A 10/2000 Kinvaid
6,165,904 A 12/2000 Kim
6,521,004 B1 2/2003 Culler
6,551,366 B1 4/2003 D'Souza
6,620,214 B2 9/2003 McArdle
6,632,129 B2 10/2003 Goetz
6,645,624 B2 11/2003 Adefris
6,790,126 B2 9/2004 Wood
7,044,835 B2 5/2006 Mujumdar
7,169,031 B1 1/2007 Fletcher
7,494,519 B2 2/2009 Fletcher
7,594,845 B2 9/2009 Lugg
7,887,608 B2 2/2011 Schwabel
8,137,157 B2 3/2012 Fletcher
8,323,072 B1 12/2012 Billig
2004/0163946 A1 8/2004 Chang
2006/0128291 A1 6/2006 Muldowney
2007/0026770 A1 2/2007 Fletcher
2007/0243803 A1 10/2007 Oka
2011/0021114 A1 1/2011 McArdle
2011/0256813 A1 10/2011 Fletcher
2011/0256818 A1 10/2011 Swedek
2011/0281510 A1 11/2011 Swedek
2012/0252324 A1 10/2012 Hreha
2012/0255635 A1 10/2012 Banda
2013/0017765 A1 1/2013 Coad
2014/0102010 A1 4/2014 Allison
2015/0190902 A1 * 7/2015 Woo ..... B24D 3/20 451/59

FOREIGN PATENT DOCUMENTS

WO WO 2009/140622 11/2009
WO WO 2012-173885 12/2012

OTHER PUBLICATIONS

Hyprez Engis Flat Lapping/Polishing Systems, Engis Corporation, 2008, 16 pages.
International Search Report for PCT International Application No. PCT/US2015/027105 dated Aug. 11, 2015, 3 pages.
Extended EP Search Report, EP 15786533.8, dated Nov. 21, 2017 (11 pages).

* cited by examiner

INTERRUPTED STRUCTURED ABRASIVE ARTICLE AND METHODS OF POLISHING A WORKPIECE

BACKGROUND

Abrasive articles are useful for a variety of grinding and finishing applications. One such application is precision lapping and polishing. Single-side lapping and polishing apparatuses typically have a large platen that rotates relative to the workpiece. Double-side machines utilize a pair of opposing platens which rotate relative to the workpiece. Both types of machines can be used with fixed abrasives (e.g., a structured abrasive disc) or liquid abrasive slurries.

Structured abrasive articles have an abrasive layer comprising shaped abrasive composites secured to a backing. The shaped abrasive composites comprise abrasive particles retained in a binder material.

During single-sided polishing, one or more workpieces are mounted to a carrier that freely rotates relative to the first platen. Workpieces are typically removably held in the carrier; for example, using wax. In such a configuration (e.g., see FIG. 1) the workpiece is contacted with a structured abrasive disc mounted on the large platen. A common problem that occurs during single-sided polishing operations is that the workpiece is not fully polished across the entire surface to be polished (also termed as "cleared" in the polishing art). There is a continuing need for materials and methods that improve the polishing process.

SUMMARY

The present inventors have discovered that the problem of incomplete clearing of the workpiece in single-sided polishing processes can be generally eliminated using polishing methods in which the workpiece repeatedly passes beyond the edge of the structured abrasive article's abrading surface. The methods are especially effective in those cases where the workpiece cannot freely rotate with respect to the carrier, as the problem of incomplete clearing is much less when the workpiece is capable of independent rotation from the carrier. Accordingly, the present disclosure provides methods and abrasive articles that provide a uniformly polished surface of a workpiece such as, for example, a sapphire wafer.

In one aspect, the present disclosure provides a first method of polishing a workpiece, the method comprising;

providing a polishing apparatus comprising:

a polishing member rotatable about a central first axis, wherein the polishing member has a first major surface having an area, wherein the first major surface is perpendicular to the first axis, wherein an interrupted structured abrasive article is secured to the first major surface of the polishing member, wherein the interrupted structured abrasive article comprises an abrasive layer disposed on and secured to a backing, wherein the abrasive layer comprises shaped abrasive composites comprising abrasive particles retained in a binder material, wherein at least one outer hole extends through the abrasive layer and the backing wherein the first axis does not pass through any one of the said at least one outer hole, wherein each of said at least one outer hole independently defines a respective open region coplanar with the abrasive layer, wherein the combined total area of the respective open regions of said at least one outer hole totals at least 10 areal percent of the first major surface of the backing; and a carrier member having a second major surface, wherein the workpiece is removably fastened to the second major surface, wherein the carrier member is independently rotatable about a second axis parallel to the first axis, wherein the workpiece has an outer major surface to be polished that contacts the interrupted structured abrasive article, wherein at least 30 areal percent of the second major surface of the workpiece can be superimposed within the open region corresponding to one of the at least one outer holes, and wherein not more than 90 areal percent of the second major surface of the workpiece can be superimposed on any of the respective open regions of the outer holes; and rotating the polishing member and the carrier member to abrade the outer major surface of the workpiece.

In another aspect, the present disclosure provides a second method of polishing a workpiece, the method comprising;

providing a polishing apparatus comprising:

a polishing member rotatable about a first axis, wherein the polishing member has a planar first major surface with an interrupted structured abrasive article secured thereto, wherein the planar first major surface is perpendicular to the first axis, wherein the interrupted structured abrasive article comprises an abrasive layer secured to a first major surface of a backing, wherein the first major surface has an area, wherein the abrasive layer comprises an array of shaped abrasive composites that extend outwardly from the backing, wherein the shaped abrasive composites comprise abrasive particles retained in a binder material, wherein the abrasive layer defines at least one open region that is free of the array of shaped abrasive composites and has a substantially uniform depth relative to the backing; and a carrier member having a second major surface, wherein the workpiece is removably fastened to the second major surface, and wherein the workpiece has an outer major surface to be polished that contacts the interrupted structured abrasive article, wherein at least 30 areal percent of the second major surface of the workpiece can be superimposed within at least one of the at least one open regions, and wherein not more than 90 areal percent of the second major surface of the workpiece can be superimposed on any one of said at least one open region; and rotating the polishing member and the carrier member to abrade the outer major surface of the workpiece.

In yet another aspect, the present disclosure provides an interrupted structured abrasive article comprising an abrasive layer secured to a first major surface of a backing, wherein the first major surface has an area, wherein the abrasive layer comprises an array of shaped abrasive composites that extend outwardly from the backing, wherein the shaped abrasive composites comprise abrasive particles retained in a binder material, wherein the abrasive layer defines at least one open region that is free of the array of shaped abrasive composites and has a substantially uniform depth relative to the backing, wherein each one of said at least one open region comprises a circular area of at least 1.5 square centimeters, and wherein said at least one open region has a combined total area that is at least 10 percent of the area of the first major surface of the backing.

As used herein, the term "areal" means of or relating to or involving an area (e.g., on an area basis).

As used herein, the term "array" refers to an arrangement of a series of terms in some regular order or arrangement (e.g., as in a rectangular matrix or a honeycomb pattern).

Features and advantages of the present disclosure will be further understood upon consideration of the detailed description as well as the appended claims.

Figure 1A:
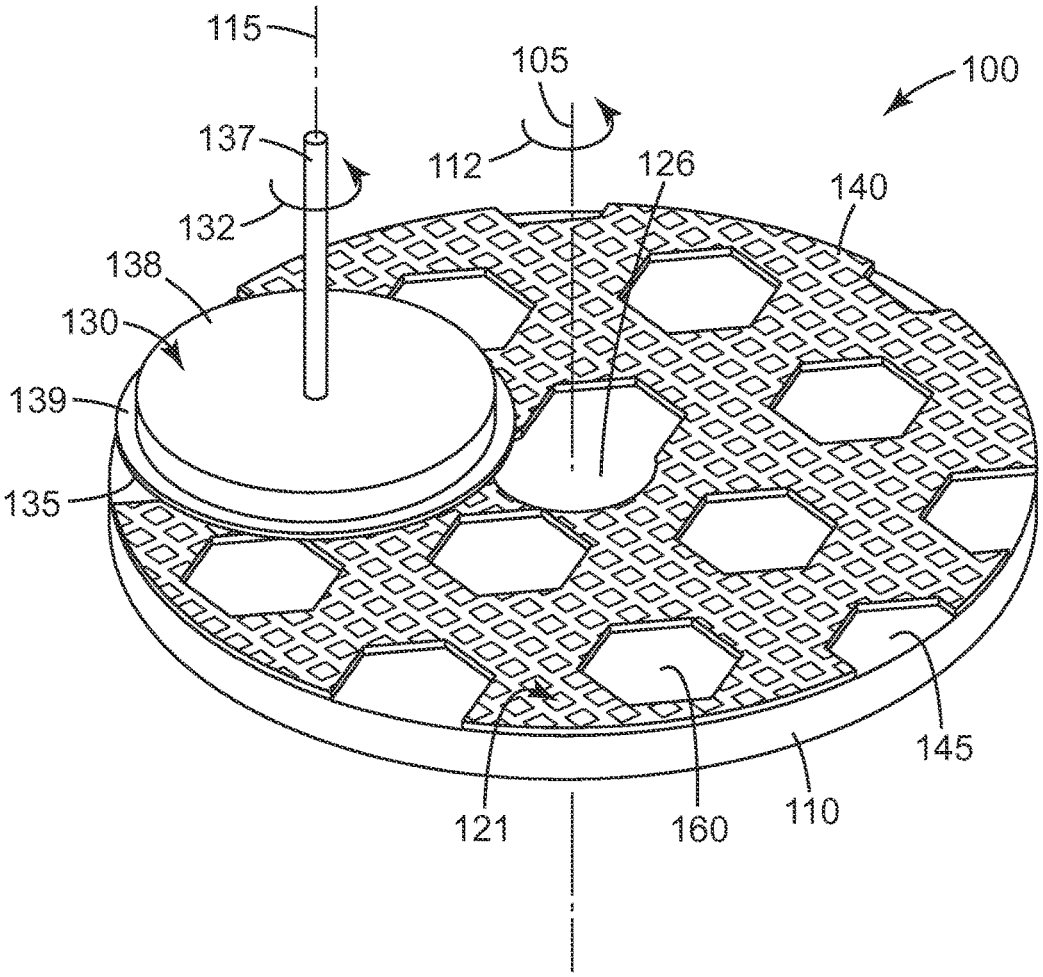
FIG. 1A is a schematic perspective view of an exemplary single-side polishing apparatus 100 polishing a workpiece according to one exemplary embodiment of the present disclosure.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figure may not be drawn to scale.

DETAILED DESCRIPTION

Figure 1B:
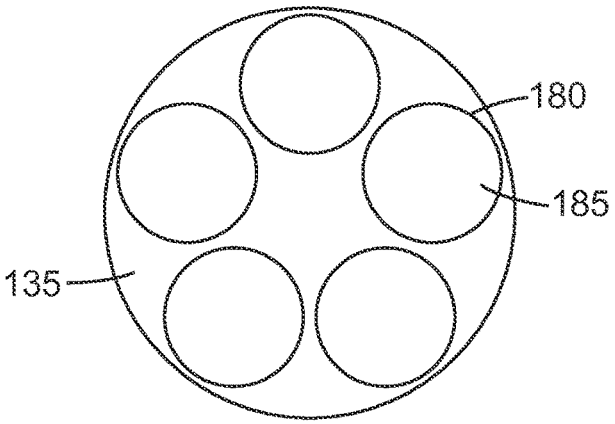
FIG. 1B is a bottom plan view of carrier support 139 shown in FIG. 1A holding workpieces 180.

Interrupted structured abrasive articles and methods, according to the present disclosure, suitable for one-sided polishing processes of the general type are shown in FIG. 1. Referring now to FIG. 1, interrupted structured abrasive article 140 is secured to first major surface 145 of polishing member 110, which is rotatable about first axis 105, and which passes through optional central arbor hole 126. Carrier member 130 has second major surface 135 facing first major surface 145. Carrier member 130 includes carrier support 139 mounted to backup plate 138. Backup plate 138 is attached to rotatable shaft 137. Workpieces 180 (see FIG. 1B) are removably fastened to second major surface 135 of carrier member 130. Carrier member 130 is independently rotatable about second axis 115 which is parallel to first axis 105. In use, the carrier member 130 and polishing member 110 are brought close enough that the outer major surfaces 185 of workpieces 180 (see FIG. 1B) contact abrasive layer 121 of interrupted structured abrasive article 140. Abrasive layer 121 has open regions 160 therein formed depending on the specific embodiment of the present disclosure. As carrier member 130 and polishing member 110 independently rotate in respective directions 132 and 112, which may be the same or opposite, abrasive layer 121 abrades outer major surfaces 185 of workpieces 180.

Suitable polishing members 110 are preferably rotatable circular platens, although this is not a requirement. Any suitable shape may be used.

Suitable carrier members 130 are preferably rotatable circular platens, although this is not a requirement. Suitable carrier members may have a planar second major surface 135, or the second major surface may have one or more recesses formed therein adapted to receive the workpiece(s).

Suitable workpieces 180 may have any shape, but preferably have a substantially uniform thickness (i.e., not including thickness variations due to micron-scale surface roughness to be removed by polishing). For example, suitable workpieces may have a substantially uniform thickness in a range of 0.1 to 1.0 millimeter. Suitable workpieces may be polygonal (e.g., rectangular, pentagonal, or hexagonal), circular, elliptical, or some other shape. Preferably, the workpieces comprises circular wafers of substantially uniform thickness. Workpieces of any dimensions may be used, but preferably the workpieces comprise circular wafers that are 1 to 12 inches (2.5 to 30.5 cm) in diameter.

Suitable workpieces may comprise any material capable of being abraded by the interrupted structured abrasive article (i.e., abrasive particles in the abrasive layer of interrupted structured abrasive article are harder than the workpiece). Examples of suitable materials when diamond abrasive particles are included in the abrasive layer of the interrupted structured abrasive article include sapphire, silicon carbide, spinel, quartz, aluminum oxynitride, and combinations thereof. Suitable workpieces also include, for example, laminates of these materials, for example, silicon carbide bonded to glass, sapphire bonded to glass, and calcite bonded to glass.

The workpiece(s) may be removably fastened to the carrier member using any suitable method such as, for example, by an adhesive material such as wax, a hot-melt adhesive, a pressure-sensitive adhesive, and/or mechanical restraint.

Polishing methods according to the present disclosure can be practiced with a single workpiece or multiple workpieces, preferably multiple workpieces. Details concerning general single-side polishing methods readily adaptable to practicing the present disclosure are well known to those of skill in the art, and are typically available from polishing equipment manufacturers.

There are several embodiments of suitable interrupted structured abrasive articles for practicing methods according to the present disclosure.

Figure 2A:
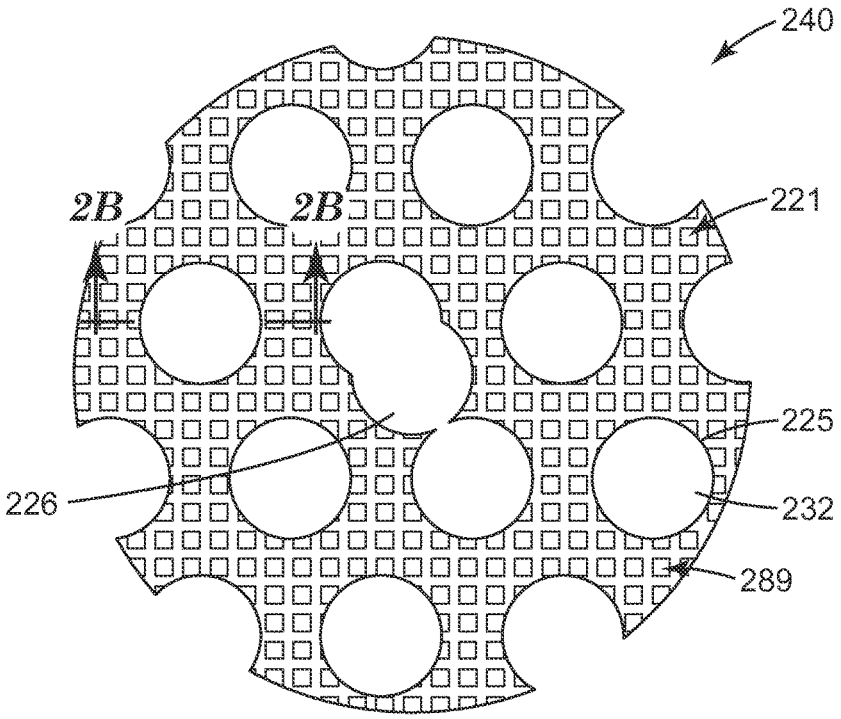
FIG. 2A is a plan view of exemplary interrupted structured abrasive article 240 suitable for practicing a first method according to the present disclosure.
Figure 2B:
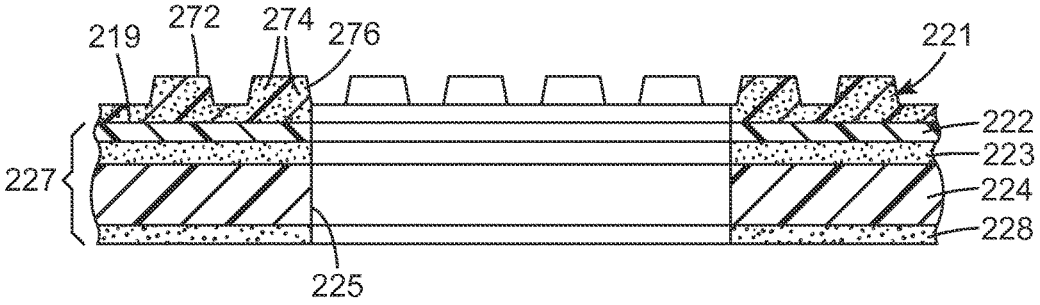
FIG. 2B is a partial cross-sectional side view of interrupted structured abrasive article 240 taken along plane 2B-2B.
Figure 3A:
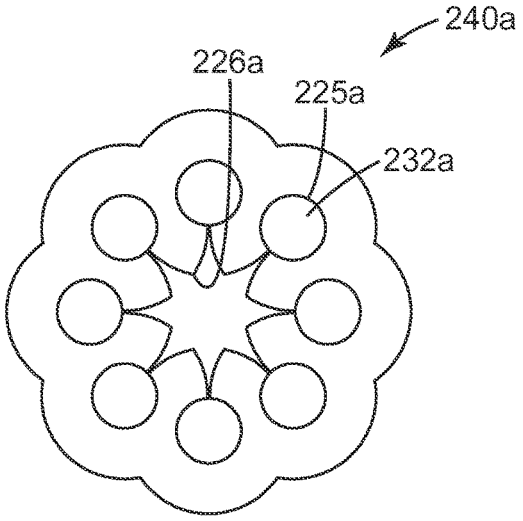
FIGS. 3A-3D are plan views of exemplary interrupted structured abrasive articles 240*a* to 240*d* suitable for practicing the first method according to the present disclosure.
Figure 3B:
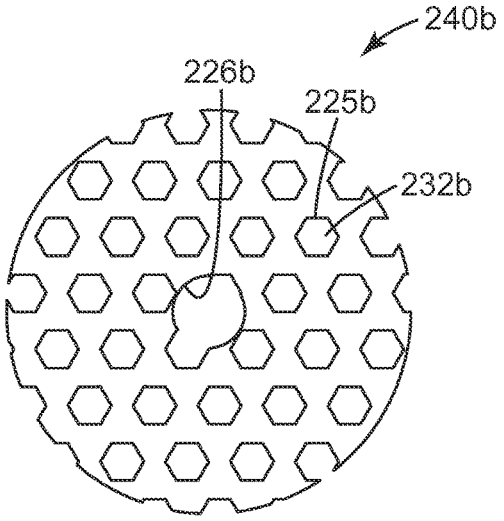
Figure 3C:
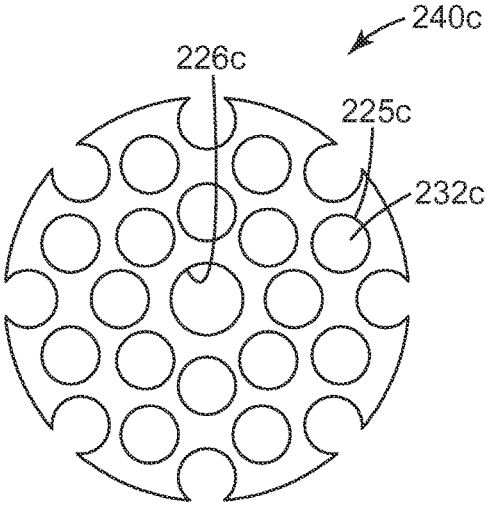
Figure 3D:
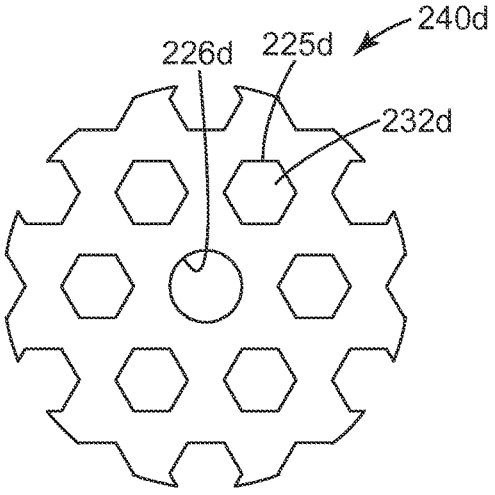

In a first embodiment, exemplified in FIGS. 2A and 2B, interrupted structured abrasive disc 240 comprises abrasive layer 221 disposed on and secured to first major surface 219 of backing 227. Optional central arbor hole 226 and outer holes 225 pass through abrasive layer 221 and backing 227. Backing 227 comprises support layer 222, optional first adhesive layer 223, optional reinforcing subpad 224, and optional second adhesive layer 228.

Abrasive layer 221 comprises array 289 of shaped abrasive composites 272 comprising abrasive particles 274 retained in binder material 276. Outer holes 225 define open regions 232 that are coplanar with abrasive layer 221. The combined total area of open regions 232 totals at least 10 areal percent of first major surface 219 of backing 227.

In some embodiments, at least 30, at least 40, or even at least 50 areal percent up to 60, 70, 80, or 90 areal percent of the outer surface of the workpiece to be polished can be superimposed within at least one of open regions 232.

Open regions 232 of outer holes 225 may have a combined total area of at least 10, 15, 20, or even at least 30 percent of the total area of first major surface 219, although this is not a requirement.

Any suitable pattern of the outer holes and open regions that retains structural integrity of the interrupted structured abrasive article may be used. FIGS. 3A-3D respectively show, optional arbor holes 226*a*-226*d*, patterns of open regions 232*a*-232*d* formed by holes 225*a* to 225*d* in exemplary interrupted structured abrasive articles 240*a*-240*d*.

Figure 4A:
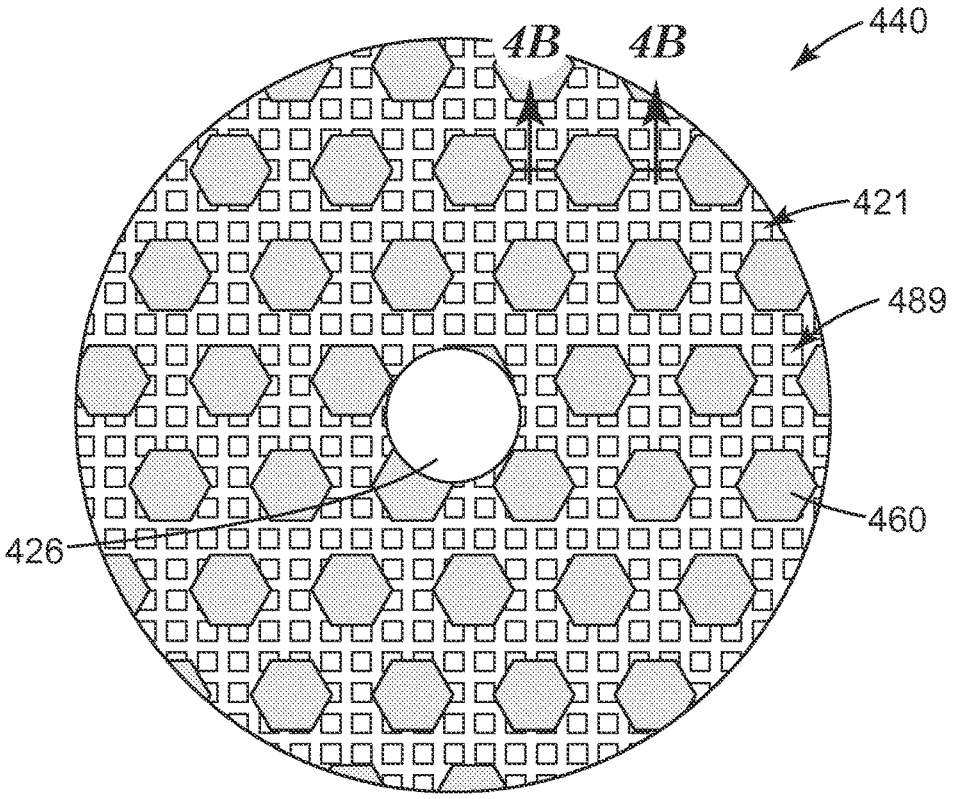
FIG. 4A is a plan view of exemplary interrupted structured abrasive article 440 suitable for practicing a first method according to the present disclosure.
Figure 4B:
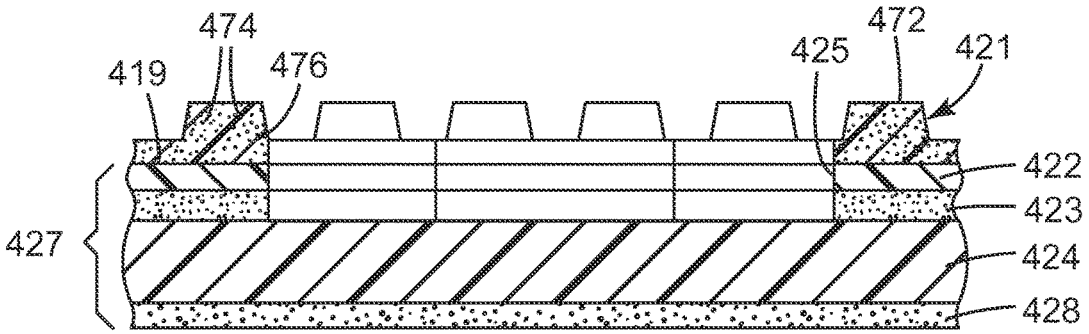
FIG. 4B is a partial cross-sectional side view of interrupted structured abrasive article 440 in FIG. 1A taken along plane 4B-4B.
Figure 5A:
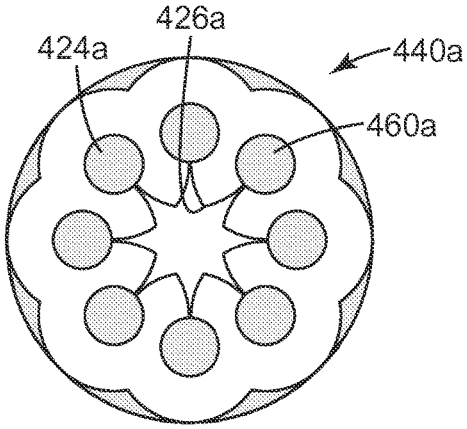
FIGS. 5A-5I are plan views of respective exemplary interrupted structured abrasive articles 440*a*-440*i* suitable for practicing the first method according to the present disclosure.
Figure 5B:
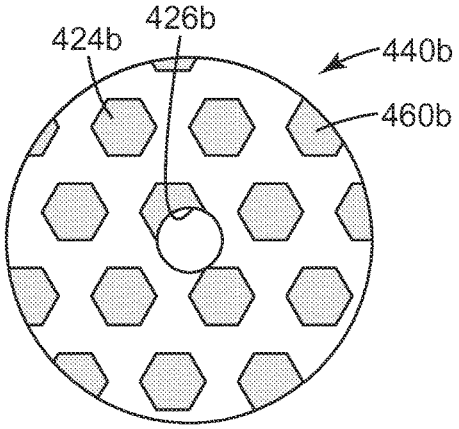
Figure 5C:
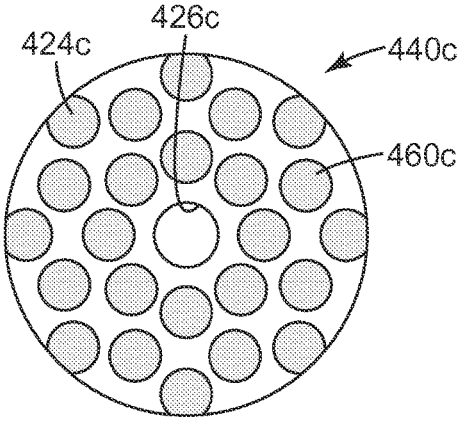
Figure 5D:
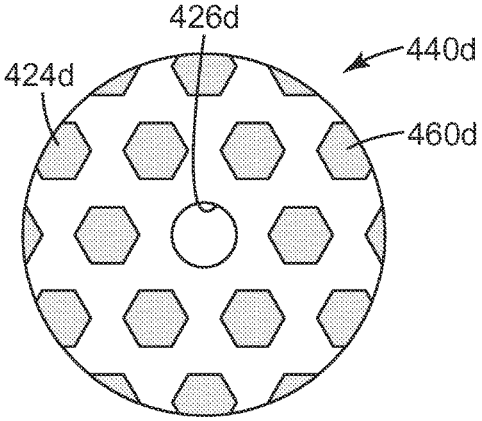
Figure 5E:
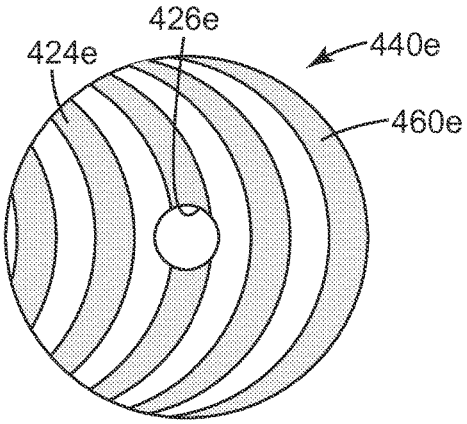
Figure 5F:
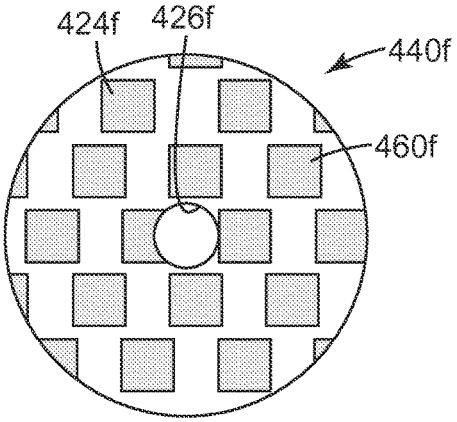
Figure 5G:
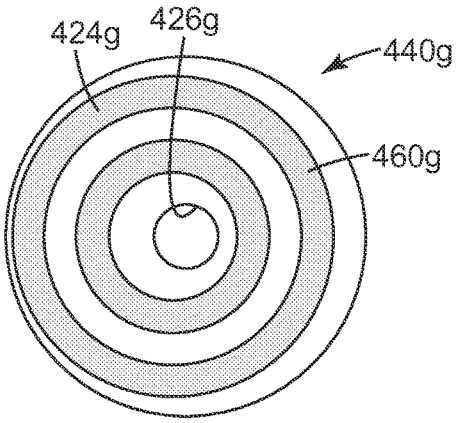
Figure 5H:
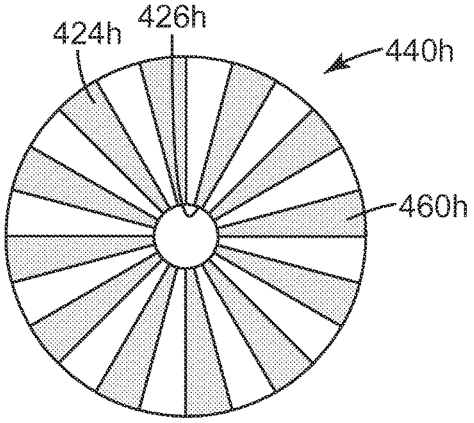
Figure 5I:
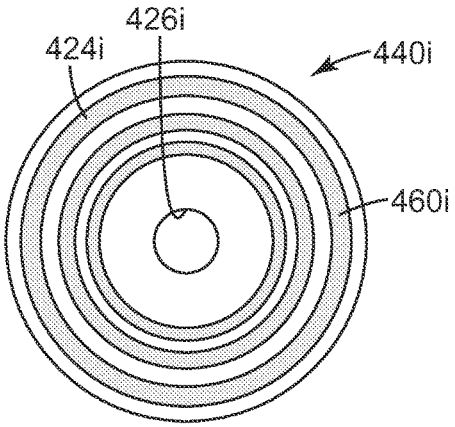

In a second embodiment, exemplified in FIGS. 4A and 4B, interrupted structured abrasive disc 440 comprises abrasive layer 421 disposed on and secured to first major surface 419 of backing 427. Backing 427 (which may be a unitary or composite backing) comprises support layer 422, first adhesive layer 423, reinforcing subpad 424, and optional second adhesive layer 426. Abrasive layer 421 comprises an array 489 of shaped abrasive composites 472 that extend outwardly from backing 427. Shaped abrasive composites 472 comprise abrasive particles 474 retained in binder material 476. Abrasive layer 421 defines open regions 460 that are free of array 489 of shaped abrasive composites 472. Open regions 460 extend through abrasive layer 421, support layer 422, and first adhesive layer 423 to reinforcing subpad 424. Open regions 460 have a substantially uniform depth relative to backing 427 (e.g., extending in the backing to reinforcing subpad 424, which extends uniformly across the bottoms of the open regions 460). Open regions 460 each comprise a circular area of at least 1.5 square centimeters. Open regions 460 have a combined total area that is at least 10 percent (e.g., at least 10, 15, 20, 25, 30, 35, or 40 percent) of the area of the first major surface 419 of backing 427.

In some embodiments, at least 30, at least 40, or even at least 50 areal percent up to 60, 70, 80, or 90 areal percent of the outer surface of the workpiece to be polished can be superimposed within at least one of open regions 460.

Open regions 460 may have a combined total area of at least one percent, 10 percent, 15 percent, 20 percent, or 30 percent of the total area of first major surface 419, although this is not a requirement.

Any suitable pattern of the open regions 460 that retains structural integrity of the interrupted structured abrasive article may be used. FIGS. 5A-5I respectively show, optional arbor holes 426*a*-426*i*, and open regions 460*a*-460*i* through which reinforcing subpad 424*a*-424*i* are visible, in exemplary interrupted structured abrasive articles 440*a*-440*i*.

Interrupted structured abrasive articles (e.g., discs) used in practice of the present disclosure may have at least 3, 4, 5, 6 7, 8, 9, or even at least 10 open regions, or more. At least two, three, or four of the open regions may comprise concentric rings.

Interrupted structured abrasive articles useful in practice of methods according to the present disclosure can typically be readily made from conventional structure abrasive articles (e.g., prepared as described above).

In a first method, suitable for making interrupted structured abrasive articles for use with the first method of polishing a workpiece, a structured abrasive article is cut completely through its thickness to form interruptions in the abrasive layer that pass completely through the abrasive layer and backing.

In a second method, suitable for making interrupted structured abrasive articles for use with the second method of polishing a workpiece, a structured abrasive article having an adhesive-coated backing (with the adhesive opposite the abrasive layer) is cut completely through its thickness to form interruptions in the abrasive layer that pass completely through the abrasive layer and backing, then laminated to a continuous uninterrupted sheet (e.g., a reinforcing subpad), which is optionally coated with an adhesive layer on its back surface opposite the abrasive layer.

Cutting may be accomplished using any suitable means, including, for example, using a laser, punch press, or water jet.

In some embodiments, a central arbor hole that extends through the abrasive layer and backing can be cut or otherwise formed in the interrupted structured abrasive article (e.g., especially when it is in disc form).

The shape and size of the interrupted structured abrasive article will generally depend on the selection of single-sided polishing equipment to be used, as is common in the art. Preferably, the interrupted structured abrasive article is shaped as a disc with a diameter ranging from 6 inches (15 cm) up to 36 inches (91 cm), or more.

A discussion of details concerning conventional structured abrasive articles that can be used to make the interrupted structured abrasive articles, and methods for their preparation, follows.

Abrasive particles included in shaped abrasive composites used in practice of the present disclosure should typically be selected such that they are harder than the workpiece surface to be abraded. The abrasive particles may be present as individual abrasive particles, of a single type of abrasive particle or a combination of abrasive particles, or a combination thereof.

The abrasive particles may also be present in abrasive aggregates. Such aggregates comprise a plurality of the abrasive particles, a matrix material, and optional additives. The matrix material may be organic and/or inorganic. The matrix material can be, for example, polymer resin, glass (e.g., vitreous-bond diamond aggregates), metal, glass-ceramic, ceramic (e.g., ceramic-bond agglomerates as described in U.S. Pat. No. 6,790,126 (Wood et al.)), or a combination thereof. For example, glass, such as silica glass, glass-ceramics, borosilicate glass, phenolic, epoxy, acrylic, and the other resins described in the context of the composite binder can be used as the matrix material. Abrasive aggregates may be randomly shaped or have a predetermined shape associated with them. Additional details regarding various abrasive aggregates and methods of making them may be found, for example, in U.S. Pat. No. 4,311,489 (Kressner); U.S. Pat. No. 4,652,275 (Bloecher et al.); U.S. Pat. No. 4,799,939 (Bloecher et al.); U.S. Pat. No. 5,549,962 (Holmes et al.); U.S. Pat. No. 5,975,988 (Christianson); U.S. Pat. No. 6,620,214 (McArdle); U.S. Pat. No. 6,521,004 (Culler et al.); U.S. Pat. No. 6,551,366 (D'Souza et. al.); U.S. Pat. No. 6,645,624 (Adefris et al.); U.S. Pat. No. 7,169,031 (Fletcher et at); U.S. Pat. No. 7,887,608 (Schwabel et al.); and in U.S. Publ. Patent Appl. 2007/0026770 (Fletcher et al.).

The abrasive particles should generally be selected to have a size distribution that can achieve an acceptable resulting finish at a reasonable rate. The abrasive particles preferably have an average particle size of about 0.01 micrometer (small particles) to 500 micrometers (large particles), more preferably about 0.25 micrometers to about 500 micrometers, even more preferably about 3 micrometers to about 400 micrometers, and most preferably about 5 micrometers to about 50 micrometers. Occasionally, abrasive particle sizes are reported as "mesh" or "grade", both of which are commonly known abrasive particle sizing methods.

Preferably, the abrasive particles have a Mohs hardness of at least 8, more preferably at least 9. Examples of such abrasive particles include fused aluminum oxide, ceramic aluminum oxide, heated treated aluminum oxide, silicon carbide, diamond (natural and synthetic), cubic boron nitride, and combinations thereof. Softer abrasive particles, such as garnet, iron oxide, alumina zirconia, mullite, and ceria, can also be used, for example. The abrasive particles may further comprise a surface treatment or coating, such as a coupling agent or metal or ceramic coatings.

Suitable binders for inclusion in the shaped abrasive composites used in practice of the present disclosure are typically formed from a binder precursor, which is a resin that is in an uncured or unpolymerized state. During the manufacture of structured abrasive articles, the binder precursor is polymerized or cured, such that a binder is formed. The binder precursor can be a condensation curable resin, an addition polymerizable resin, a free radical curable resin, and/or combinations and blends of such resins.

One preferred binder precursor is a resin or resin mixture that polymerizes via a free-radical mechanism. The polymerization process is initiated by exposing the binder precursor, along with an appropriate catalyst, to an energy source such as thermal energy or radiation energy. Examples of radiation energy include electron beam, ultraviolet light, or visible light.

Examples of free-radical curable resins include acrylated urethanes, acrylated epoxies, acrylated polyesters, ethylenically-unsaturated monomers, aminoplast monomers having pendant unsaturated carbonyl groups, isocyanurate monomers having at least one pendant acrylate group, isocyanate monomers having at least one pendant acrylate group, and mixtures and combinations thereof. As used herein, the term "(meth)acrylate" includes acrylates and methacrylates.

One preferred binder precursor comprises a urethane (meth)acrylate oligomer, or a blend of a urethane (meth) acrylate oligomer and an ethylenically-unsaturated monomer. The preferred ethylenically-unsaturated monomers are monofunctional (meth)acrylate monomers, difunctional (meth)acrylate monomers, trifunctional (meth)acrylate monomers, or combinations thereof. The binder formed from these binder precursors provides the interrupted structured abrasive article with its desired properties. In particular, these binders provide a tough, durable, and long lasting medium to securely hold the abrasive particles throughout the life of the interrupted structured abrasive article. This binder chemistry is especially useful when used with diamond abrasive particles because diamond abrasive particles last substantially longer than most conventional abrasive particles. In order to take full advantage of the long life associated with diamond abrasive particles, a tough and durable binder is desired. Thus, this combination of urethane (meth)acrylate oligomer or blend of urethane (meth)acrylate oligomer with an (meth)acrylate monomer and diamond abrasive particles provides an abrasive coating that is long lasting and durable.

Examples of acrylated urethanes include those available as EBECRYL 220 hexafunctional aromatic urethane acrylate (molecular weight 1000 grams/mole), EBECRYL 284 aliphatic urethane diacrylate (1200 grams/mole molecular weight diluted with 1,6-hexanediol diacrylate), EBECRYL 4827 aromatic urethane diacrylate (1600 grams/mole molecular weight), EBECRYL 4830 aliphatic urethane diacrylate (1200 grams/mole molecular weight diluted with tetraethylene glycol diacrylate), EBECRYL 6602 trifunctional aromatic urethane acrylate (1300 grams/mole molecular weight diluted with trimethylolpropane ethoxy triacrylate), and EBECRYL 840 aliphatic urethane diacrylate (1000 grams/mole molecular weight) from UCB Radcure Inc., Smyrna, Ga., as SARTOMER 9635, 9645, 9655, 963-B80, and 966-A80 from Sartomer Company, Exton, Pa., and as UVITHANE 782 from Morton International, Chicago, Ill.

The ethylenically-unsaturated monomers or oligomers, or (meth)acrylate monomers or oligomers, may be monofunctional, difunctional, trifunctional or tetrafunctional, or even higher functionality. Ethylenically-unsaturated binder precursors include both monomeric and polymeric compounds that contain atoms of carbon, hydrogen, and oxygen, and optionally, nitrogen and the halogens. Ethylenically-unsaturated monomers or oligomers preferably have a molecular weight of less than about 4,000 grams/mole, and are preferably esters made from the reaction of compounds containing one or more aliphatic hydroxyl groups and one or more unsaturated carboxylic acids such as acrylic acid, methacrylic acid, itaconic acid, crotonic acid, isocrotonic acid, maleic acid, and the like.

Representative examples of ethylenically-unsaturated monomers include methyl methacrylate, ethyl methacrylate, styrene, divinylbenzene, hydroxyethyl acrylate, hydroxyethyl methacrylate, hydroxypropyl acrylate, hydroxypropyl methacrylate, hydroxybutyl acrylate, hydroxybutyl methacrylate, vinyltoluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerythritol triacrylate, pentaerythritol trimethacrylate, pentaerythritol tetraacrylate, and pentaerythritol tetramethacrylate. Other ethylenically-unsaturated monomers or oligomers include monoallyl, polyallyl, and polymethallyl esters and amides of carboxylic acids, such as diallyl phthalate, diallyl adipate, and N,N-diallyladipamide. Still other nitrogen containing compounds include tris(2-acryloxyethyl)-isocyanurate, 1,3,5-tris(2-methacryloxyethyl)-s-triazine, acrylamide, methylacrylamide, N-methylacrylamide, N,N-dimethylacrylamide, N-vinylpyrrolidone, and N-vinylpiperidone. Examples of ethylenically-unsaturated diluents or monomers may be found in U.S. Pat. No. 5,236,472 (Kirk) and U.S. Pat. No. 5,580,647 (Larson et al.).

In general, the ratio between these (meth)acrylate monomers depends upon the weight percent of diamond abrasive particles and any optional additives or fillers desired in the particular abrasive article. Typically, these (meth)acrylate monomers range from about 5 parts by weight to about 95 parts by weight urethane acrylate oligomer to about 5 parts by weight to about 95 parts by weight ethylenically-unsaturated monomer. Additional information concerning other potential useful binders and binder precursors is found in U.S. Pat. No. 4,773,920 (Chasman et al.) and U.S. Pat. No. 5,958,794 (Bruxvoort et al.).

Acrylated epoxies are diacrylate esters of epoxy resins, such as the diacrylate esters of bisphenol A epoxy resin. Examples of acrylated epoxies include those available as CMD 3500, CMD 3600, and CMD 3700 from Radcure Specialties SA, Brussels, Belgium, and as CN103, CN104, CN111, CN112, and CN114 from Sartomer Company, Exton, Pa.

Aminoplast monomers have at least one pendant $\alpha,\beta$-unsaturated carbonyl group. These unsaturated carbonyl groups may be acrylate, methacrylate, or acrylamide-type groups. Examples of such materials include N-(hydroxymethyl)acrylamide, N,N'-oxydimethylenebisacrylamide, ortho- and para-acrylamidomethylated phenols, acrylamidomethylated phenolic novolac, and combinations thereof. These materials are further described in U.S. Pat. No. 4,903,440 (Kirk et al.) and U.S. Pat. No. 5,236,472 (Kirk et al.).

Isocyanurates having at least one pendant acrylate group and isocyanate derivatives having at least one pendant acrylate group are further described in U.S. Pat. No. 4,652,274 (Boettcher et al.). The preferred isocyanurate material is a triacrylate of tris(hydroxyethyl) isocyanurate.

Depending upon how the free radical curable resin is cured or polymerized, the binder precursor may further comprise a curing agent, (which is also known as a catalyst or initiator). When the curing agent is exposed to the appropriate energy source, it will generate a free radical source that will start the polymerization process.

Another preferred binder precursor comprises an epoxy resin. Epoxy resins have an oxirane ring and are polymerized by a ring opening reaction. Such epoxide resins include monomeric epoxy resins and polymeric epoxy resins. Examples of preferred epoxy resins include 2,2-bis-4-(2,3-epoxypropoxy)phenylpropane, a diglycidyl ether of bisphenol, which include those available as EPON 828, EPON 1004, and EPON 1001F from Momentive, Columbus, Ohio, and as DER-331, DER-332, and DER-334 from Dow Chemical Co., Midland, Mich. Other suitable epoxy resins include cycloaliphatic epoxies, and glycidyl ethers of phenol formaldehyde novolac (for example, those available as DEN-431 and DEN-428 from Dow Chemical Co.). Examples of usable multi-functional epoxy resins include those available as MY 500, MY 510, MY 720, and TACTIX 742 from Huntsman, Salt Lake City, Utah, and as EPON HPT 1076 and EPON 1031 from Momentive. The blend of free-radically curable resins and epoxy resins are further described in U.S. Pat. No. 4,751,138 (Tumey et al.) and U.S. Pat. No. 5,256,170 (Harmer et al.).

It is preferred that any of the binder materials, when incorporated with the abrasive particles in the abrasive article, have high thermal resistance. Specifically, the cured binder preferably has a glass transition temperate (i.e., $T_g$) at least 150 degrees Celsius (° C.), preferably at least 160° C. In some embodiments, a $T_g$ of at least 175° C. is desired. A $T_g$ as high as 200° C. may be preferred in some embodiments.

The backing serves the function of providing a support for the shaped abrasive composites. The backing should be capable of adhering to the binder after exposure of binder precursor to curing conditions, and be strong and durable so that the resulting abrasive article is long lasting. The backing may be a unitary backing or composite backing. Exemplary backings may comprise polymeric film, paper, vulcanized fiber, a molded or cast elastomer, a treated nonwoven backing, treated cloth, and combinations thereof (e.g., laminated or adhered together with adhesive). Examples of suitable polymers for inclusion in the backing include polyesters, co-polyesters, polycarbonates, polyimides, and polyamides. A nonwoven, including paper, may be saturated with either a thermosetting or thermoplastic material to provide the necessary properties.

Referring again to FIG. 4B, optional reinforcing subpad 424 is preferably rigid or semi-rigid. In some preferred embodiments, reinforcing subpad 424 comprises a sheet of an engineering thermoplastic such, as for example, polycarbonate, polyimide, polyether ether ketone (PEEK), polyether ketone (PEK), or polyetherimide. Optional reinforcing subpad may include multiple layers, including a substantially rigid layer and a substantially resilient layer. Reinforcing subpads containing multiple layers are known in the art and include those disclosed in U.S. Pat. No. 5,692,950 (Rutherford et. al.) and U.S. Pat. No. 6,632,129 (Goetz).

Useful adhesives for optional adhesive layers 223, 228, 423, and 428 include pressure-sensitive adhesives (e.g., acrylic pressure-sensitive adhesives), hot melt adhesives (e.g., styrene-butadiene block hot melt adhesives), and cure in place adhesives (e.g., two-part epoxy) for example. If an optional adhesive layer such as 426 is present, then it a releasable liner may be provided on the adhesive layer to protect it from dust and/or accidental adhesion to a substrate.

Any of the above backing materials may further include additives such as: fillers, fibers, dyes, pigments, wetting agents, coupling agents, plasticizers, and the like. The backing can also contain a reinforcing scrim or cloth including, for example, a cloth of available as NOMEX from E.I. du Pont de Nemours and Company, Wilmington, Del.

In some instances it may be preferable to have an integrally molded backing; that is, a backing directly molded adjacent the composites instead of independently attaching the composites to a backing such as, for example, a cloth. The backing may be molded or cast onto the back of the composites after the composites are molded, or molded or cast simultaneously with the composites. The backing can be molded from either thermal or radiation-curable thermoplastic or thermosetting resins. Examples of typical and preferred thermosetting resins include phenolic resins, aminoplast resins, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, and mixtures thereof. Examples of preferred thermoplastic resins include polyamide resins (for example, nylon), polyester resins and polyurethane resins (including polyurethane-urea resins). One preferred thermoplastic resin is a polyurethane derived from the reaction product of a polyester polyol or polyether polyol and an isocyanate. The backing chemistry can be identical or is similar to the composite chemistry.

The shaped abrasive composites may be arranged in any pattern, but preferably are arranged according to a regular array. The height of the shaped abrasive composites is generally greater than or equal to 25 microns and less than or equal to about 5 millimeters; preferably, less than 2 millimeters, although greater and lesser heights may also be used.

The areal density of the pyramidal and/or truncated pyramidal abrasive composites in the structured abrasive layer may be, for example, in a range of from at least 10, 20, 30, or even at least 50 abrasive composites per square inch (at least 1.5, 3.1, 4.7, or even at least 7.8 abrasive composites per square centimeter) up to and including 100, 1000, 10000, or even as many as 100,000 abrasive composites per square inch (up to and including 15, 150, 1500, or even as many as 15000 abrasive composites per square centimeter), although greater or lesser densities of abrasive composites may also be used.

The abrasive layer has shaped abrasive composites, preferably identically shaped and arranged on the backing according to a repeating pattern (e.g., a regular array), although neither of these is a requirement. The shaped abrasive composites preferably comprise posts (e.g., cylindrical posts or prisms), pyramids, and/or truncated pyramids. Prisms, pyramids, and truncated pyramids may have three, four, five, or six sides, for example. Preferably, the shaped abrasive composites have the same size and shape, but combinations of differently sized and/or shaped abrasive composites may also be used. The sides of the shaped abrasive composites may be the same or different. In some preferred embodiments, the shaped abrasive composites have a substantially uniform depth (e.g., within manufacturing tolerances) relative to the backing, although this is not a requirement.

Structured abrasive articles are typically prepared by forming a slurry of abrasive grains and a polymerizable binder precursor, coating the slurry in an appropriate tool (having the inverse topography as that desired for the final structured abrasive article), contacting the slurry with a backing and polymerizing the binder precursor (for example, by exposure to an energy source) in a manner such that the resulting structured abrasive article has a plurality of shaped abrasive composites affixed to the backing. Examples of energy sources include thermal energy and radiant energy (including electron beam, ultraviolet light, and visible light).

The abrasive slurry is made by combining together by any suitable mixing technique the binder precursor, the abrasive grains and the optional additives. Examples of mixing techniques include low shear and high shear mixing, with high shear mixing being preferred. Ultrasonic energy may also be utilized in combination with the mixing step to lower the abrasive slurry viscosity. Typically, the abrasive particles are gradually added into the binder precursor. The amount of air bubbles in the abrasive slurry can be minimized by pulling a vacuum either during or after the mixing step. In some instances, it is useful to heat, generally in the range of 30 to 70° C., the abrasive slurry to lower the viscosity. The abrasive slurry may contain additives that help disperse and/or suspend the abrasive particle in the binder precursor. Additives of this nature are selected based on the abrasive particle type, size and surface chemistry, and/or the specific chemistry and viscosity of the binder precursor, and are well known in the art.

For example, in one embodiment, the slurry may be coated directly onto a production tool having shaped cavities (corresponding to the desired structured abrasive layer) therein, and brought into contact with the backing, or coated on the backing and brought to contact with the production tool. In this embodiment, the slurry is typically then solidified (for example, a least partially cured) or cured while it is present in the cavities of the production tool, and the backing is separated from the tool thereby forming a structured abrasive article.

Further details concerning structured abrasive articles having shaped abrasive composites, and methods for their manufacture may be found, for example, in U.S. Pat. No. 5,152,917 (Pieper et al.); U.S. Pat. No. 5,435,816 (Spurgeon et al.); U.S. Pat. No. 5,672,097 (Hoopman); U.S. Pat. No. 5,681,217 (Hoopman et al.); U.S. Pat. No. 5,454,844 (Hibbard et al.); U.S. Pat. No. 5,851,247 (Stoetzel et al.); U.S. Pat. No. 6,139,594 (Kincaid et al.); and U.S. Pat. No. 7,044,835 (Mujumdar et al.), for example, starting at column 18, line 45 and proceeding until column 19, line 26.

Structured abrasive articles are also available from commercial sources such as, for example, 3M Company, Saint Paul, Minn., under the trade designation 3M TRIZACT DIAMOND TILE abrasive pad (e.g., in 3.0 micron, 6.0 micron, and 9.0 micron diamond particle sizes). These are available in forms with and without a pressure-sensitive adhesive backing layer, as well as with and without a polycarbonate reinforcing subpad optionally backed with a pressure-sensitive adhesive layer. The abrading/polishing method may also include a working fluid. Any known working fluid can be used, including working fluids containing organic liquid(s), water (i.e., aqueous solutions) and combinations thereof, with particular selection within the skill of the art. Various additives also can be incorporated in the working fluid, include, for example, lubricants, coolants, grinding aids, dispersing agents, and suspending agents. Additives also may be used to chemically interact with the workpiece surface to improve the polishing process. One commercially available coolant is CHALLENGE 543-HT, available from Intersurfaces Dynamics, Inc., Bethel, Conn.

Conditioning particles may be added to the working fluid. One example of such particles is abrasive grit that can form part of a slurry during use or in a polishing system. The conditioning particles have a hardness below that of the intended workpiece, such that minimal or no appreciable abrading or grinding of the workpiece results from the conditioning particles. However, the conditioning particles have a hardness about the same or above that of the matrix material of the abrasive agglomerates, if used as abrasive particles in the abrasive composites, and the conditioning particles condition or abrade this matrix material to expose fresh abrasive particles. Conditioning particles also may condition the binder of the abrasive composite, exposing fresh abrasive particles. One commercially available conditioning particle, is 5 micron plated white alumina, available as PWA 5 from Fujimi Inc., Kiyosu, Japan.

Process conditions for abrading workpieces according to the present disclosure may vary depending on the apparatus used, and are with the capabilities of one of ordinary skill in the art. Exemplary process parameters for abrading a workpiece according to the present disclosure are given below: contact pressure of 1 to 20 pounds per square inch (psi, 6.9 to 138 kPa), preferably 2 to 10 psi (13.8 to 68.9 kPa); carrier member speed of 5 to 120 revolutions per minute (rpm), preferably 20 to 80 rpm; polishing member speed of 5 to 120 revolutions per minute (rpm), preferably 20 to 80 rpm; and a working fluid flow rate of 5 to 500 milliliters/minute (mL/min), preferably 20 to 200 mL/min, although these are not requirements.

SELECT EMBODIMENTS OF THE PRESENT DISCLOSURE

In a first embodiment, the present disclosure provides a method of polishing a workpiece, the method comprising;

providing a polishing apparatus comprising:

a polishing member rotatable about a central first axis, wherein the polishing member has a first major surface having an area, wherein the first major surface is perpendicular to the first axis, wherein an interrupted structured abrasive article is secured to the first major surface of the polishing member, wherein the interrupted structured abrasive article comprises an abrasive layer disposed on and secured to a backing, wherein the abrasive layer comprises shaped abrasive composites comprising abrasive particles retained in a binder material, wherein at least one outer hole extends through the abrasive layer and the backing wherein the first axis does not pass through any one of the said at least one outer hole, wherein each of said at least one outer hole independently defines a respective open region coplanar with the abrasive layer, wherein the combined total area of the respective open regions of said at least one outer hole totals at least 10 areal percent of the first major surface of the backing; and a carrier member having a second major surface, wherein the workpiece is removably fastened to the second major surface, wherein the carrier member is independently rotatable about a second axis parallel to the first axis, wherein the workpiece has an outer major surface to be polished that contacts the interrupted structured abrasive article, wherein at least 30 areal percent of the second major surface of the workpiece can be superimposed within the open region corresponding to one of the at least one outer holes, and wherein not more than 90 areal percent of the second major surface of the workpiece can be superimposed on any of the respective open regions of the outer holes; and rotating the polishing member and the carrier member to abrade the outer major surface of the workpiece.

In a second embodiment, the present disclosure provides a method according to the first embodiment, wherein the shaped abrasive composites have a substantially uniform depth relative to the backing.

In a third embodiment, the present disclosure provides a method according to the first or second embodiment, wherein the combined total respective open region of said at least one outer hole totals at least 20 areal percent of the first major surface of the backing.

In a fourth embodiment, the present disclosure provides a method according to any one of the first to third embodiments, wherein said at least one outer hole comprises at least four of the outer holes.

In a fifth embodiment, the present disclosure provides a method of polishing a workpiece, the method comprising;

providing a polishing apparatus comprising:

a polishing member rotatable about a first axis, wherein the polishing member has a planar first major surface with an interrupted structured abrasive article secured thereto, wherein the planar first major surface is perpendicular to the first axis, wherein the interrupted structured abrasive article comprises an abrasive layer secured to a first major surface of a backing, wherein the first major surface has an area, wherein the abrasive layer comprises an array of shaped abrasive composites that extend outwardly from the backing, wherein the shaped abrasive composites comprise abrasive particles retained in a binder material, wherein the abrasive layer defines at least one open region that is free of the array of shaped abrasive composites and has a substantially uniform depth relative to the backing; and a carrier member having a second major surface, wherein the workpiece is removably fastened to the second major surface, and wherein the workpiece has an outer major surface to be polished that contacts the interrupted structured abrasive article, wherein at least 30 areal percent of the second major surface of the workpiece can be superimposed within at least one of the at least one open regions, and wherein not more than 90 areal percent of the second major surface of the workpiece can be superimposed on any one of said at least one open region; and rotating the polishing member and the carrier member to abrade the outer major surface of the workpiece.

In a sixth embodiment, the present disclosure provides a method according to the fifth embodiment, wherein the interrupted structured abrasive article has a centrally disposed arbor hole that extends through the abrasive layer and the backing.

In a seventh embodiment, the present disclosure provides a method according to the fifth or sixth embodiment, wherein the shaped abrasive composites have a substantially uniform depth relative to the backing.

In an eighth embodiment, the present disclosure provides a method according to any one of the fifth to seventh embodiments, wherein said at least one open region has a combined total area that is at least 20 areal percent of the first major surface of the backing.

In a ninth embodiment, the present disclosure provides a method according to any one of the fifth to eighth embodiments, wherein said at least one open region comprises at least four of the open regions.

In a tenth embodiment, the present disclosure provides a method according to any one of the fifth to ninth embodiments, wherein the at least one open region comprises at least two concentric rings.

In an eleventh embodiment, the present disclosure provides an interrupted structured abrasive article comprising an abrasive layer secured to a first major surface of a backing, wherein the first major surface has an area, wherein the abrasive layer comprises an array of shaped abrasive composites that extend outwardly from the backing, wherein the shaped abrasive composites comprise abrasive particles retained in a binder material, wherein the abrasive layer defines at least one open region that is free of the array of shaped abrasive composites and has a substantially uniform depth relative to the backing, wherein each one of said at least one open region comprises a circular area of at least 1.5 square centimeters, and wherein said at least one open region has a combined total area that is at least 10 percent of the area of the first major surface of the backing.

In a twelfth embodiment, the present disclosure provides an interrupted structured abrasive article according to the eleventh embodiment, wherein the interrupted structured abrasive article has a centrally disposed arbor hole that extends through the abrasive layer and the backing.

In a thirteenth embodiment, the present disclosure provides an interrupted structured abrasive article according to the eleventh or twelfth embodiment, wherein the shaped abrasive composites have a substantially uniform depth relative to the backing.

In a fourteenth embodiment, the present disclosure provides an interrupted structured abrasive article according to any one of the eleventh to thirteenth embodiments, wherein the array of shaped abrasive composites is a regular array.

In a fifteenth embodiment, the present disclosure provides an interrupted structured abrasive article according to any one of the eleventh to fourteenth embodiments, wherein the at least one open region has a combined total area that is at least 20 areal percent of the first major surface of the backing.

In a sixteenth embodiment, the present disclosure provides an interrupted structured abrasive article according to any one of the eleventh to fifteenth embodiments, wherein the at least one open region comprises at least four of the open regions.

In a seventeenth embodiment, the present disclosure provides an interrupted structured abrasive article according to any one of the eleventh to sixteenth embodiments, wherein the at least one open region comprises at least two concentric rings.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

Test Methods and Measurement Techniques

Polishing Test Method

The 28 inch (71.1 cm) diameter pad was adhered to the 28 inch (71.1 cm) diameter platen of a polishing tool, a HYPREZ 28" SINGLE SIDED POLISHER available from Engis Corporation, Wheeling, Ill. Three 6-inch (15.2 cm) diameter, c-plane sapphire wafers were mounted to a 12 inch (30.5 cm) diameter×0.75 inch (1.9 cm) thick, flat metal (steel) carrier using wax, as follows. Wax, having a melting point of about 90° C., available under the trade designation TECH-WAX from Transene Company, Inc., Danvers, Mass. was melted and spin coated onto a major surface of each wafer, creating a thin wax coating on each waver. A flat, metal carrier is warmed in an oven above the melting point of the wax. The wafers are placed on the warm, metal carrier, with the wax side adjacent to the carrier, and a load of about 25 kg is applied evenly and simultaneously to the surface of the three wafers. The wax is allowed to cool, adhering the wafers to the carrier. The surface of the c-plane sapphire wafers was pre-conditioned to have a surface finish, Ra, of about 0.6 mm by lapping with 80 μm EL 3M TRIZACT DIAMOND TILE fixed abrasive pad available from the 3M Company, St. Paul, Minn. The carrier was then attached to the 10 inch (25.4 cm) diameter carrier support of the tool. Polishing was conducted at platen speed of 60 rpm and the carrier was allowed to freely rotate (no mechanical drive), with the platen and carrier both rotating counterclockwise (co-rotating), as viewed from above. The force on the wafers and thus the corresponding pressure on the wafers was varied and was either a force of 254 lbf (3 psi (20.7 kPa)), or a force of 381 lbf (4.5 psi (31.0 kPa)). A lubricant was used, 5% by volume CHALLENGE 543-HT, available from Intersurfaces Dynamics, Inc., Bethel, Conn., in deionized water with 1 percent by volume of a 5 micron plated white alumina, available under the trade designation "PWA 5" from Fujimi Inc., Kiyosu, Japan. The lubricant was applied to the pad at a flow rate of about 30 mL/min at a location approximately 10 inches (25.4 cm) from the edge of the pad. Three polishing cycles were run on each batch of wafers, the polishing times per cycle being 20 minutes, 20 minutes and 60 minutes for a total polishing time of 100 minutes. After each cycle, the wafers were removed from the metal carrier and the removal rate and surface finish, Ra, were measured. The wafers were remounted to the metal carrier for the next cycle of polishing.

Removal Rate Measurement

Wafers were measured gravimetrically before and after polishing. The measured weight loss was used to determine the amount of material removed, based on a wafer density of 3.97 g/cm$^3$. Removal rate, reported in μm/min, is the average thickness reduction of the three wafers over the indicated polishing time interval (see Table 1).

Surface Finish Measurement

After polishing, sapphire wafers were rinsed with deionized water and dried. Surface roughness measurements, including $R_a$, $R_z$, and $R_{max}$, were measured using a MAHR-Pocket Surf model PS1 available from University of North Carolina, Charlotte, N.C. The 0.25 micron diameter stylus travel was set at 1.5 cm and the scan rate was 0.5 mm/sec.

Wafer Clearing Measurement

After polishing, the wafers were visually examined to determine if the wafer had cleared, i.e., the surface of the wafer was uniformly polished so that the entire wafer surface appeared visually clear. If all or part of the surface area still had visual imperfections, causing an opaque surface appearance, the wafer was said to have not cleared.

Example 1

A 6 micron EL 3M TRIZACT DIAMOND TILE structured abrasive pad, available from the 3M Company, was obtained in a 28 inch diameter (71.1 cm) size. A 5 inch (12.7 cm) diameter center hole and a hexagonal array of circular holes (as shown in FIG. 2A), each hole having a 5 inch (12.7 cm) diameter, with a 7.5 inch (19.1 cm) center to center distance between holes, were cut in the pad via a water jet cutting process, Example 1.

Comparative Example A (CE-A)

A 6 μm (6 micron) EL 3M TRIZACT DIAMOND TILE structured abrasive pad, available from the 3M Company, was obtained in a 28 inch diameter (71.1 cm) size. A 5 inch (12.7 cm) diameter center hole was cut in the pad via a water jet cutting process, CE-A.

The Polishing Test Method was applied to Example 1, at a polishing pressure of 3 psi, and CE-A, at polishing pressures of 3 psi (20.7 kPa) and 4.5 psi (31.0 kPa). For CE-A, the same pad was used for the test at the two different pressures. Removal rate, Ra and whether or not the wafer cleared were determined according to the test methods described above. Results are shown in Table 1 (below).

TABLE 1

| Pad | Polishing Time per cycle (min) | Pressure (psi) | Removal Rate (μm/min) | Ra (μm) | Wafer Cleared |
|---|---|---|---|---|---|
| Example 1 | 0 | 3 | — | 0.62 | — |
| | 20 | 3 | 0.24 | 0.10 | No |
| | 20 | 3 | 0.17 | 0.08 | Yes |
| | 60 | 3 | 0.12 | 0.06 | Yes |
| CE-A | 0 | 3 | — | 0.66 | — |
| | 20 | 3 | 0.25 | 0.21 | No |
| | 20 | 3 | 0.05 | 0.15 | No |
| | 60 | 3 | 0.01 | 0.06 | No |
| CE-A | 0 | 4.5 | — | 0.72 | — |
| | 20 | 4.5 | 0.32 | 0.11 | No |
| | 20 | 4.5 | 0.11 | 0.06 | No |
| | 60 | 4.5 | 0.04 | 0.06 | No |

As can be observed from the data of Table 1, the pad with additional holes cut into it, Example 1, was able to clear the wafers after a total polishing time of about 40 minutes at a polishing pressure of 3 psi. The pads without holes were unable to clear the wafers, even after 100 minutes of total polishing time and at polishing pressures as high as 4.5 psi.

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A method of polishing a workpiece, the method comprising;

providing a polishing apparatus comprising:

a polishing member rotatable about a central first axis, wherein the polishing member has a first major surface having an area, wherein the first major surface is perpendicular to the first axis, wherein an interrupted structured abrasive article is secured to the first major surface of the polishing member, wherein the interrupted structured abrasive article comprises an abrasive layer disposed on and secured to a backing, wherein the abrasive layer comprises shaped abrasive composites comprising abrasive particles retained in a binder material, wherein at least one outer hole extends through the abrasive layer and the backing wherein the first axis does not pass through any one of the said at least one outer hole, wherein each of said at least one outer hole independently defines a respective open region coplanar with the abrasive layer, wherein the combined total area of the respective open regions of said at least one outer hole totals at least 10 areal percent of the first major surface of the backing; and a carrier member having a second major surface, wherein the workpiece is removably fastened to the second major surface, wherein the carrier member is independently rotatable about a second axis parallel to the first axis, wherein the workpiece has an outer major surface to be polished that contacts the interrupted structured abrasive article, wherein at least 30 areal percent of the second major surface of the workpiece can be superimposed within the open region corresponding to one of the at least one outer holes, and wherein not more than 90 areal percent of the second major surface of the workpiece can be superimposed on any of the respective open regions of the outer holes; and rotating the polishing member and the carrier member to abrade the outer major surface of the workpiece.

2. The method of claim 1 wherein the shaped abrasive composites have a substantially uniform depth relative to the backing.

3. The method of claim 1, wherein the combined total respective open region of said at least one outer hole totals at least 20 areal percent of the first major surface of the backing.

4. The method of claim 1, wherein said at least one outer hole comprises at least four of the outer holes.

5. A method of polishing a workpiece, the method comprising;

providing a polishing apparatus comprising:

a polishing member rotatable about a first axis, wherein the polishing member has a planar first major surface with an interrupted structured abrasive article secured thereto, wherein the planar first major surface is perpendicular to the first axis, wherein the interrupted structured abrasive article comprises an abrasive layer secured to a first major surface of a backing, wherein the first major surface has an area, wherein the abrasive layer comprises an array of shaped abrasive composites that extend outwardly from the backing, wherein the shaped abrasive composites comprise abrasive particles retained in a binder material, wherein the abrasive layer defines at least one open region that is free of the array of shaped abrasive composites and has a substantially uniform depth relative to the backing; and a carrier member having a second major surface, wherein the workpiece is removably fastened to the second major surface, and wherein the workpiece has an outer major surface to be polished that contacts the interrupted structured abrasive article, wherein at least 30 areal percent of the second major surface of the workpiece can be superimposed within at least one of the at least one open regions, and wherein not more than 90 areal percent of the second major surface of the workpiece can be superimposed on any one of said at least one open region; and rotating the polishing member and the carrier member to abrade the outer major surface of the workpiece.

6. The method of claim 5, wherein the interrupted structured abrasive article has a centrally disposed arbor hole that extends through the abrasive layer and the backing.

7. The method of claim 5, wherein the shaped abrasive composites have a substantially uniform depth relative to the backing.

8. The method of claim 5, wherein said at least one open region has a combined total area that is at least 20 areal percent of the first major surface of the backing.

9. The method of claim 5, wherein said at least one open region comprises at least four of the open regions.

10. The method of claim 5, wherein the at least one open region comprises at least two concentric rings.

11. An interrupted structured abrasive article comprising an abrasive layer secured to a first major surface of a backing, wherein the first major surface has an area, wherein the abrasive layer comprises an array of shaped abrasive composites that extend outwardly from the backing, wherein the shaped abrasive composites comprise abrasive particles retained in a binder material, wherein the abrasive layer defines at least one open region that is free of the array of shaped abrasive composites and has a substantially uniform depth relative to the backing, wherein each one of said at least one open region comprises a circular area of at least 1.5 square centimeters, and wherein said at least one open region has a combined total area that is at least 10 percent of the area of the first major surface of the backing; wherein the at least one open region comprises at least two concentric rings.

12. The interrupted structured abrasive article of claim 11, wherein the interrupted structured abrasive article has a centrally disposed arbor hole that extends through the abrasive layer and the backing.

13. The interrupted structured abrasive article of claim 11, wherein the shaped abrasive composites have a substantially uniform depth relative to the backing.

14. The interrupted structured abrasive article of claim 11, wherein the array of shaped abrasive composites is a regular array.

15. The interrupted structured abrasive article of claim 11, wherein the at least one open region has a combined total area that is at least 20 areal percent of the first major surface of the backing.

16. The interrupted structured abrasive article of claim 11, wherein the at least one open region comprises at least four of the open regions.

* * * * *